US007296881B2

(12) United States Patent
Langford et al.

(10) Patent No.: US 7,296,881 B2
(45) Date of Patent: Nov. 20, 2007

(54) PRINTHEAD DE-PRIMING

(75) Inventors: Jeffrey D Langford, Lebanon, OR (US); Ross E Friesen, Corvallis, OR (US); Carrie E. Harris, Corvallis, OR (US); Harold F Mantooth, Vancouver, WA (US); Donald L Michael, Monmoth, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 350 days.

(21) Appl. No.: 11/040,601

(22) Filed: Jan. 21, 2005

(65) Prior Publication Data

US 2006/0164470 A1 Jul. 27, 2006

(51) Int. Cl.
*B41J 2/17* (2006.01)
*B41J 2/175* (2006.01)

(52) U.S. Cl. ..... 347/84; 347/85

(58) Field of Classification Search ..... 347/21, 347/89, 92, 93, 85, 86, 40, 65, 87, 28, 84
See application file for complete search history.

(56) References Cited

U.S. PATENT DOCUMENTS 4,223,324 A * 9/1980 Yamamori et al. ..... 347/21
4,791,438 A * 12/1988 Hanson et al. ..... 347/87
4,931,812 A * 6/1990 Dunn et al. ..... 347/87
5,084,712 A * 1/1992 Hock et al. ..... 347/28
5,182,581 A * 1/1993 Kashimura et al. ..... 347/87
5,936,650 A 8/1999 Ouchida et al.
6,007,193 A * 12/1999 Kashimura et al. ..... 347/92
6,116,727 A * 9/2000 Hagiwara ..... 347/89
6,224,198 B1 * 5/2001 Cook et al. ..... 347/85
6,224,201 B1 * 5/2001 Shigemura ..... 347/93
6,773,097 B2 8/2004 Dowell
7,121,653 B2 * 10/2006 Lai ..... 347/85
2002/0118256 A1 * 8/2002 Dixon et al. ..... 347/85
2005/0007427 A1 * 1/2005 Bellinger et al. ..... 347/86
2005/0157009 A1 * 7/2005 Silverbrook et al. ..... 347/40

* cited by examiner

*Primary Examiner*—Hai Pham
*Assistant Examiner*—Carlos A. Martinez, Jr.

(57) ABSTRACT

A valve mechanism and a method for preparing an inkjet print cartridge and printer for inactivity is herein disclosed. Pressurized fluid is introduced to a standpipe volume to create a pressure differential that forces ink within the standpipe into an ink reservoir.

21 Claims, 4 Drawing Sheets

PRINTHEAD DE-PRIMING

TECHNICAL FIELD

The present invention relates generally to methods and mechanisms for preventing failures in an inkjet print cartridge. More specifically, the present invention relates to a venting mechanism used to prepare inkjet print cartridges for periods of inactivity.

BACKGROUND

Inkjet print cartridges typically use inks that include a volatile solvent such as alcohol and/or water. Where inkjet print cartridges remain inactive for long periods, as when the print cartridge is in transit to an end user, is in storage, or where the printer in which the print cartridge is installed is not used for long periods, the solvents in the inks will begin to evaporate. This evaporation is especially problematic in the area of the nozzles of the print cartridge as the evaporating solvents leave behind solid deposits of pigments and the like that can occlude the nozzles, thereby rending the print cartridge inoperative and/or can reduce the print quality thereof.

Many steps have been taken to prevent the evaporation of ink solvents from a print cartridge, with the aim of preventing occlusions of the print cartridge nozzle. One solution has been to apply tape over the print cartridge nozzles. While this solution does reduce evaporation of solvents from the ink in the print cartridge, it does not prevent all such evaporation. Furthermore, the use of tape over the nozzles of the printhead is typically useful only prior to the installation of the print cartridge in a printer; a user cannot easily reapply tape over the nozzles of the print cartridge.

Another solution is to provide a pumping mechanism that can remove ink from the print cartridge, or at least from the region of the print cartridge adjacent the nozzles thereof; the idea being that where there is no ink, there can be no evaporation and the incidence of occlusions will decrease. However, such systems are complicated and in any case, it has been difficult to remove all ink from the region of the print cartridge adjacent to the nozzles thereof.

Accordingly, there is a need for a method and a mechanism that will facilitate the removal of ink from the region of a print cartridge adjacent to the nozzles thereof where the print cartridge will remain inactive for a time. In addition, there is a need for a mechanism that can prime a print cartridge in which ink has been removed from the region of the print cartridge adjacent the nozzles so that the print cartridge may begin or resume printing.

DETAILED DESCRIPTION

Figure 1:
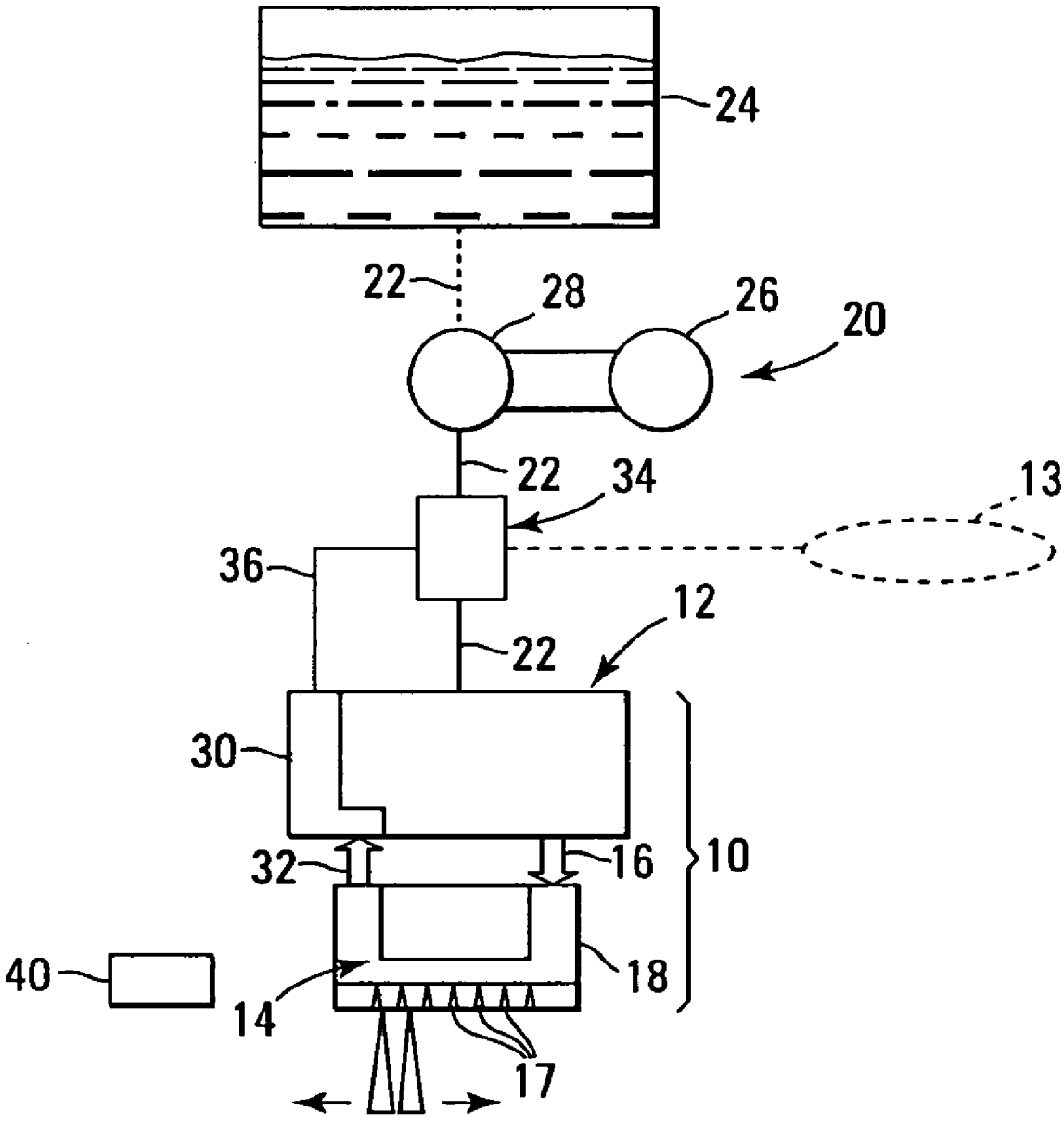
FIG. 1 is a schematic cross section view of a print cartridge that incorporates one embodiment of a venting mechanism and an embodiment of an ink supply system.

In the following detailed description of the invention, reference is made to the accompanying drawings that form a part hereof and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention. The following detailed description is, therefore, not to be taken in a limiting sense, and the scope of the present invention is defined only by the appended claims and equivalents thereof.

FIG. 1 illustrates schematically one embodiment of a print cartridge 10. Print cartridge 10 has one or more reservoirs 12 that are fluidically coupled to a standpipe 14 by coupling 16. Standpipe 14 has a printhead 18 that is adapted for dispensing ink from the standpipe 14 in an inkjet printing process of a type known in the art. As ink is expelled from one or more nozzles 17 the printhead 18, a vacuum is generated in the standpipe 14 that acts to draw ink from reservoir 12 into the standpipe 14 through coupling 16. As used herein, the term vacuum pressure is used to designate a reduced pressure that is generally lower than a reference pressure, which in one embodiment is atmospheric pressure, and in another embodiment is a source of pressurized air or other fluids.

In one embodiment, coupling 16 is a passage or conduit having a check valve or filter installed therein for controlling the flow of ink from reservoir 12 to standpipe 14. That is, a vacuum within the standpipe 14 will act to draw ink through the coupling 16. However, absent a sufficiently large pressure differential, ink will not generally flow freely through the coupling 16 from the reservoir to the standpipe 14, though a nominal amount of ink may continue to flow. In one embodiment, the check valve will be selected such that the surface tension of ink and its solvents on the check valve will prevent the flow of ink therethrough where there is air or another similar fluid present on one side of the check valve, such as where all ink has been removed from the standpipe 14 and the standpipe 14 contains only air.

As ink is drawn from the reservoir 12 and into standpipe 14, a vacuum is generated within the reservoir 12. In one embodiment, the vacuum in reservoir 12 acts to draw additional ink from an auxiliary or supplemental reservoir 24 that is fluidically connected to the reservoir 12 by conduit 22. In another embodiment, a pumping mechanism 20 actively pumps ink from reservoir 24 into reservoir 12 to replenish the ink ejected by the printhead 18. Pumping mechanism 20 includes a motor 26 that is coupled to a pump 28. The pumping mechanism 20 may be manually actuated when the print cartridge 10 is determined to be out of ink or when it is determined that the level of ink in the reservoir 12 is below a predetermined minimum. Alternatively, the vacuum in the reservoir 12 may be sensed by a sensor (not shown) whose output actuates the pumping mechanism 20.

Where a print cartridge 10 is to remain unused for an extended period of time, the print cartridge 10 may be de-primed, i.e. ink may be removed from the standpipe 14 and the printhead 18 to prevent the clogging of the nozzles 17 of the printhead 18 and subsequent malfunctions of the print cartridge 10 that may arise therefrom. The print cartridge 10 is de-primed by coupling the standpipe 14 to pressures higher than those present in the reservoir 12. In one embodiment, a snorkel 30 is fluidically coupled to standpipe 14 by a conduit 32. Snorkel 30 is in turn fluidically coupled to a valve mechanism 34 by conduit 36. The valve mechanism 34 is adapted to selectively connect the snorkel 30 to atmospheric air, which is at a generally higher pressure than the vacuum within the reservoir 12 and standpipe 14. Alternatively, the valve mechanism 34 may connect the snorkel 30 to a source of high-pressure air 13.

As described above, the act of ejecting ink from the printhead 18 during printing generates a vacuum within the volume of the standpipe 14. This vacuum in turn draws ink from the reservoir 12 into the standpipe 14, thereby giving rise to a vacuum within the reservoir 12. Introducing to the standpipe 14 a higher pressure by coupling the snorkel 30 to the atmosphere or to a source of higher pressure creates a pressure differential that acts to force ink from the standpipe 14 through the conduit 16 and back into the reservoir 12. When the air or other gas introduced into the standpipe 14 contacts the check valve or filter, ink is substantially prevented from flowing into the standpipe 14 from the reservoir 12.

In one embodiment, a wiper 36 may be simultaneously employed to prevent clogging of the nozzles 17 of the printhead 18. Wiper 36 moves laterally with respect to the print cartridge 10 such that the tips 38 of the wiper 36 are drawn across the surface of the printhead 18. The wiping action of the tips 38 against the printhead 18 acts to remove excess liquid ink and/or accretions formed around or in the nozzles 17 of the printhead 18. In another embodiment, the wiper 36 may be provided with a wick 40 that dispenses a non-volatile material that, when applied to the printhead 18, prevents ink in the nozzles 17 from drying out and also prevents the ingress of air into the print cartridge 10 through the printhead 18. As wiper 36 moves laterally, the tips 38 of the wiper 36 are drawn across the wick 40 and a small amount of the non-volatile material is deposited thereon. The non-volatile material is then applied to the printhead 18 by the tips 38 of the wiper 36. In one embodiment, the non-volatile material remains relatively viscous and does not cure or harden to any significant degree. In this manner, re-priming of the print cartridge 10 is not impeded by accretions of the non-volatile material within the nozzles 17 of the printhead.

Re-priming of the print cartridge 10 in preparation for printing operations after a period of inactivity involves filling the standpipe 14 with ink. In one embodiment, the pumping mechanism 20 is activated to pump ink into the reservoir 12 under sufficient pressure to force ink through conduit 16 and into the standpipe 14. Alternatively, the valve mechanism 34 may be actuated to couple the supplemental reservoir 24 directly to the standpipe 14 such that the pumping mechanism 20 can pump ink directly into the standpipe 14 as through conduit 36. In another embodiment, the pumping mechanism 20 may be coupled to the snorkel 30. Thereafter, ink and/or air within the snorkel 30 and standpipe 14 is withdrawn by the pumping mechanism 20 to generate a vacuum therein, thereby drawing ink into the standpipe 14 from the reservoir 12 for printing.

In addition to priming and de-priming the print cartridge, the supplemental reservoir 24 and pumping mechanism 20, may also be used to supply ink to one or more print cartridges 10 to replenish the reservoir 12 during printing.

Figure 2:
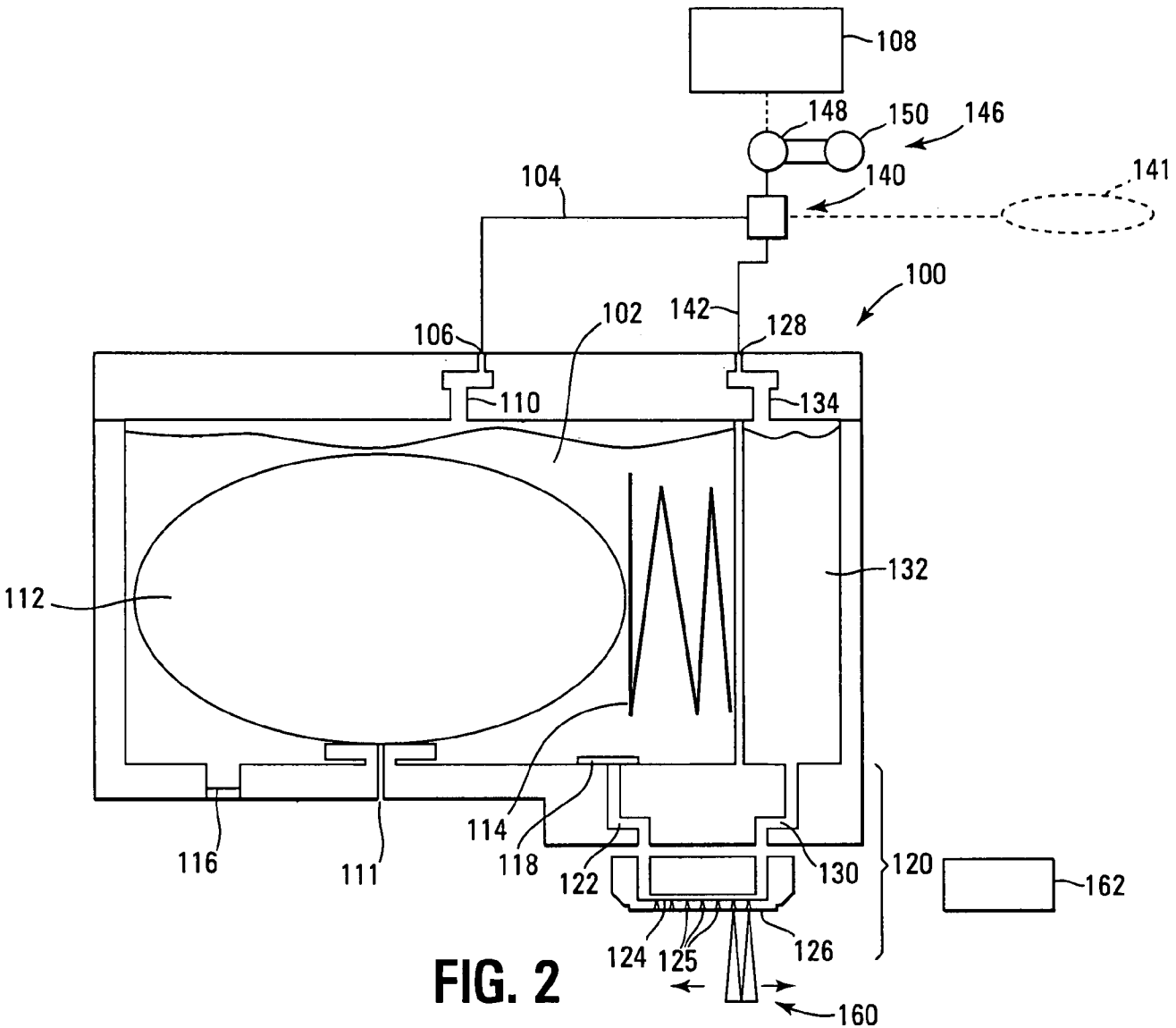
FIG. 2 is a schematic cross section view of a print cartridge that has associated therewith an ink supply system and a vent according to an embodiment of the present invention.

FIG. 2 illustrates a close-up cross-sectional view of an exemplary printhead assembly 100 according to the present invention. FIG. 2 shows only the components corresponding to a single reservoir 102 for a single color, though it is understood that printhead assembly 100 may be adapted to include multiple reservoirs, one for each color printable by a printing system. Conduit 104 is connected to printhead inlet port 106 to provide fluid communication between the off-axis ink supply container 108 and the printhead assembly 100. Inlet port 106 may have a valve mechanism (not shown) associated therewith to control the flow of ink from an off-axis ink supply container 108 to the reservoir 102. Ink flows into reservoir 102 through fluid channel 110 from conduit 104.

In one embodiment, reservoir 102 includes an accumulator bag 112 and spring 114 along with a bubbler 116 to maintain a slight negative pressure in the reservoir 102, as is known in the art. Where ink and/or air is withdrawn from the reservoir 102 through port 106, the accumulator bag 112 expands by drawing air through port 111. Spring 114 and bubbler 116 cooperate to ensure that as ink and/or air is withdrawn from reservoir 102, the accumulator bag 112 does not over inflate. Spring 114 resists pressure from the accumulator bag 112 as it inflates. Bubbler 116 includes a diaphragm or valve element that allows air to enter the reservoir 102 from the exterior, thereby limiting the reduction of pressure within the reservoir 102 to a predetermined level.

A particle filter 118 separates the reservoir 102 from the lower body portion 120 of the print head assembly 100. As needed, ink may flow through particle filter 118 into inlet channel 122 and ultimately into plenum or standpipe 124, which resides directly above a slot (not shown). The slot ultimately feeds a thermal printing device (not shown), which ejects ink through nozzles 125 disposed in the bottom side 126 of the lower body portion 120 of the printhead assembly 100, according to methods known in the art. The standpipe 124 is also fluidically connected to a port 128 via a flow path, which is shown in FIG. 2 as having a channel 130, a conduit 132 and an outlet 134. Channel 130, conduit 132 and outlet 134 may all be generically and collectively referred to herein as a snorkel.

Figure 3:
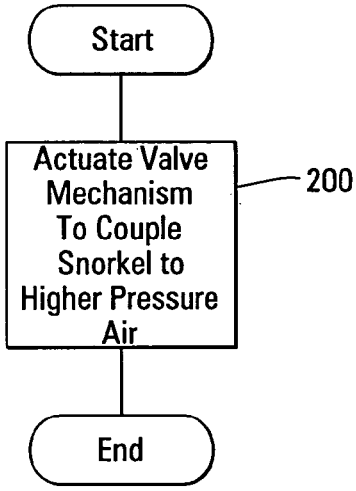
FIG. 3 is a flow chart illustrating exemplary steps in a de-priming process according to one embodiment.
Figure 4:
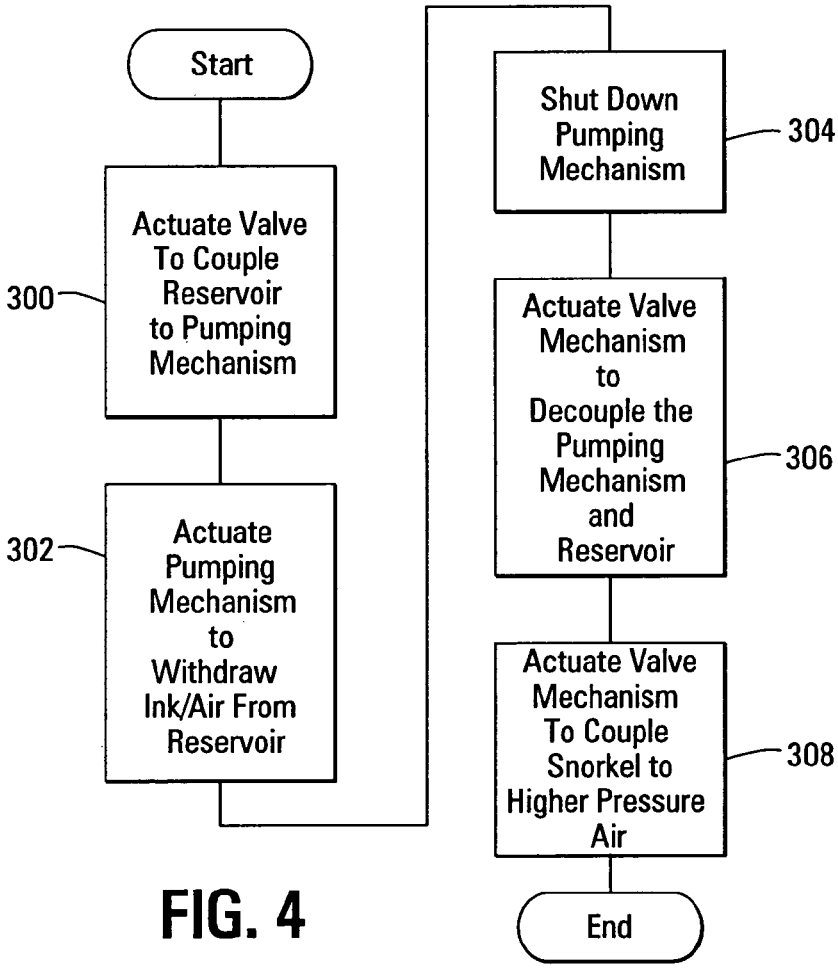
FIG. 4 is a flow chart illustrating exemplary steps in a de-priming process according to another embodiment; and, FIG. 5 is a flow chart illustrating exemplary steps in a priming process used to prepare a de-primed print cartridge for printing according to an embodiment of the present invention.

In one embodiment, ports 106 and 128 are fluidically connected to valve mechanism 140 by conduits 104 and 142, respectively. Note that in other embodiments, ports 106 and 128 may be connected to separate valve mechanisms or the like. Valve mechanism 140 is adapted to selectively couple the off-axis ink supply container 108 to the reservoir 102. In addition, the valve mechanism 140 may couple the snorkel to the atmosphere or to a supply of relatively high pressure air 141. In another embodiment, valve mechanism 140 may include multiple valves connected to one another to effect the various connections described herein in a manner known to those skilled in the art. Coupled between the valve mechanism 140 and the off-axis ink supply container 108 is a pumping mechanism 146 that includes a pump 148 that is powered by motor 150. In another embodiment, pumping mechanism 146 may be omitted in favor of a gravity flow or vacuum operated system. The printhead assembly 100 may optionally be provided with a wiper 160 and wick 162 that function as described in conjunction with FIG. 1.

Where there exists a vacuum within the reservoir 102, inlet channel 122, and standpipe 124, or where there exists a source of pressure higher than that within the reservoir 102, inlet channel 122, and standpipe 124, de-priming the printhead assembly 100 involves actuating valve mechanism 140 to couple the snorkel to atmospheric air or to a supply of air at a pressure greater than that present in the reservoir 102, inlet channel 122 and standpipe 124. This is shown in FIG. 3 at 200. The relatively higher pressure introduced into the snorkel through port 128 forces ink within the snorkel, standpipe 124, and inlet channel 122 back into the reservoir 102 through particle filter 118. When air contacts the particle filter 118, the surface tension of ink in the particle filter 118 is sufficient to substantially prevent the flow of air therethrough and is further able to substantially prevent the flow of ink from the reservoir 102 back into the inlet channel 122.

Where the pressure within the reservoir 102 and the lower body portion 120 is higher than or substantially the same as atmospheric pressure, the process of de-priming the printhead assembly 100 involves a first step of actuating the valve mechanism 140 to couple the reservoir 102 to the pumping mechanism 146 as shown at 300 in FIG. 4. Pumping mechanism 146 is then actuated to withdrawn ink and/or air from the reservoir 102, thereby creating a relatively low pressure or vacuum within the reservoir 102 as at 302. Once there is a relatively low pressure within the reservoir 102, pumping mechanism 146 is shut down (304) and the valve mechanism 140 is actuated to break the connection between the reservoir 102 and the pumping mechanism (306). Finally, valve mechanism 140 is actuated to couple the snorkel to atmospheric air or to a supply of air at a pressure greater than that present in the reservoir 102, inlet channel 122 and standpipe 124 (308).

Once ink has been removed from the region or volume adjacent the nozzles 125 of the printhead 100, wiper 160 is drawn across the nozzles 125 of the printhead assembly 100 to remove external accretions and to apply a non-volatile material obtained from the wick 162 to the orifice plate in which the nozzles 125 of the printhead assembly 100 are formed, thereby preventing the formation of accretions within the nozzles 125.

Figure 5:
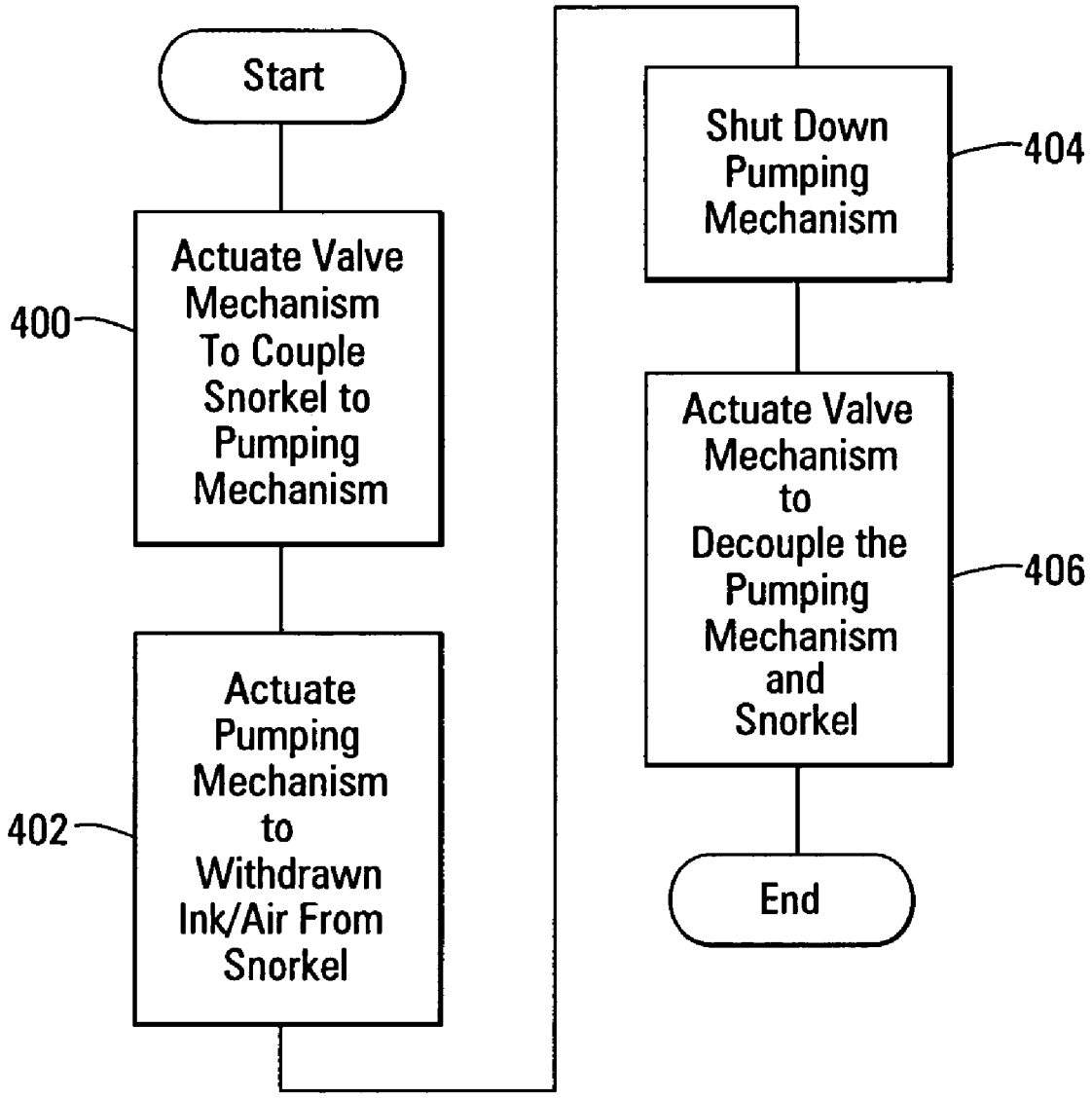

An exemplary embodiment of a method of priming the printhead assembly 100 in preparation for printing is described with reference to FIG. 5. In this embodiment, port 128 of the printhead assembly 100 is coupled to the pumping mechanism 146 by selectively actuating the valve mechanism 140 as at step 400. Thereafter, pumping mechanism 146 is actuated to draw air, and if any remains, ink, from the snorkel (step 402). The withdrawal of air/ink from the snorkel reduces the pressure therein, which subsequently induces ink to flow from the reservoir 102 through particle filter 118 into inlet channel 122 and standpipe 124. Once a sufficient pressure differential has been created as between the reservoir 102 and the lower body portion 120, the pumping mechanism 146 is shut down (step 404) and the valve mechanism 140 is actuated to de-couple port 128 from the pumping mechanism 146 (step 406). Note that valve mechanism 140, upon de-coupling port 128 from the pumping mechanism 146, also seals port 128 and prevents the ingress or escape of air. An alternate embodiment of the method illustrated in FIG. 5 involves coupling the off-axis reservoir 108 to the reservoir 102 through pumping mechanisms 146 and actuating pumping mechanism 146 to pump ink into the reservoir 102 at a pressure sufficient to force ink into the inlet channel 122 and standpipe 124.

CONCLUSION

Although specific embodiments have been illustrated and described herein, it is manifestly intended that this invention be limited only by the following claims and equivalents thereof.

What is claimed is:

1. An inkjet printer system comprising:

a printhead with at least one nozzle for ejecting droplets of ink during printing operations;

a first ink reservoir for holding a volume of ink;

a standpipe in fluidic communication with the printhead and the first ink reservoir to define an ink flow path between the first ink reservoir and the printhead;

a port that provides fluidic communication with the interior of the standpipe; and a valve mechanism fluidically coupled to the port;

wherein the valve mechanism is configured to selectively de-prime the printhead by selectively introducing air into the standpipe through the port at a pressure above that of the pressure within the standpipe and the first ink reservoir to induce ink disposed within the standpipe and the printhead to flow from the standpipe and the printhead into the first ink reservoir along the ink flow path until substantially all of the ink within the standpipe and the printhead is removed from the standpipe and the printhead and is replaced by the air.

2. The inkjet printer system of claim 1 wherein the valve mechanism is configured to selectively couple the standpipe to an air source.

3. The inkjet printer system of claim 2 wherein the air source is the atmosphere.

4. The inkjet printer system of claim 2 wherein the air source is compressed air.

5. The inkjet printer system of claim 1 further comprising a filter disposed across the ink flow path between the first ink reservoir and the standpipe.

6. The inkjet printer system of claim 1 further comprising an ink supply system fluidically coupled to the first ink reservoir and the standpipe.

7. The inkjet printer system of claim 6 wherein the ink supply system fluidically couples a remote ink reservoir to the first ink reservoir.

8. The inkjet printer system of claim 6 wherein the valve mechanism is further fluidically coupled to an inlet of the first ink reservoir, and further comprises a pumping mechanism coupled to the valve mechanism and a remote ink reservoir coupled to the pumping mechanism.

9. The inkjet printer system of claim 8 wherein the valve mechanism is constructed and arranged to selectively couple the pumping mechanism and the remote ink reservoir to one of the inlet of the first ink reservoir and the port of the standpipe.

10. The inkjet printer system of claim 9 wherein the pumping mechanism is constructed and arranged to pump air and ink in two directions.

11. The inkjet printer system of claim 8 wherein the valve mechanism is constructed and arranged to couple the standpipe to a source of pressure that is higher than the pressure present within the first ink reservoir.

12. The inkjet printer system of claim 8 wherein the valve mechanism includes a plurality of valves.

13. A method of preparing an inkjet printer system for inactivity comprising:

providing a print cartridge comprising a printhead with at least one nozzle, a first ink reservoir for holding a volume of ink, a standpipe in fluidic communication with the printhead and the first ink reservoir and defining an ink flow path from the first ink reservoir to the printhead, and a port that provides fluidic communication with the interior of the standpipe; and, introducing air into the standpipe through the port at a pressure sufficiently above that of the pressure within the standpipe and the first ink reservoir to induce ink within the standpipe to flow from the standpipe into the first ink reservoir along the ink flow path.

14. The method of preparing an inkjet printer system for inactivity of claim 13 further comprising actuating a valve mechanism coupled to the port to couple the port to a source of air at a pressure above that of the standpipe and the first ink reservoir.

15. The method of preparing an inkjet printer system for inactivity of claim 13 further comprising:

actuating a valve mechanism coupled to the port to couple the port to a pumping mechanism and actuating the pumping mechanism to withdraw ink and/or air from the standpipe prior to introducing air into the standpipe at pressures above the pressures present in the first ink reservoir and standpipe.

16. The method of preparing an inkjet printer system for inactivity of claim 13 further comprising:

priming a de-primed print cartridge to prepare the de-primed print cartridge for printing.

17. The method of preparing an inkjet printer system for inactivity of claim 13, further comprising wiping any remaining ink from the at least one nozzle.

18. The method of preparing an inkjet printer system for inactivity of claim 17, wherein wiping any remaining ink from the at least one nozzle further comprises applying a non-volatile material to the printhead.

19. A method of de-priming a print cartridge comprising:

introducing air into a standpipe in fluidic communication with a printhead, the air being at a higher pressure than that of the standpipe, the pressure of the air also being greater than that of a pressure in a first ink reservoir that is fluidically coupled to the standpipe, the first ink reservoir further fluidically coupled to the printhead for supplying ink to the printhead during printing;

wherein introducing the air into the standpipe induces ink within the standpipe and the printhead to flow from the standpipe into the first ink reservoir; and wherein the air is introduced into the standpipe until substantially all of the ink within the standpipe and the printhead is removed from the standpipe and the printhead and into the first ink reservoir and the ink removed from the standpipe and printhead is replaced by the air.

20. The method of de-priming a print cartridge of claim 19 further comprising:

priming a de-primed print cartridge to prepare the de-primed print cartridge for printing.

21. The method of de-priming a print cartridge of claim 20 further comprising:

actuating a valve mechanism coupled to the standpipe of the de-primed print cartridge to couple the standpipe to a pumping mechanism; and, activating the pumping mechanism to lower the pressure within the standpipe to a level at which ink is drawn into the standpipe from the first ink reservoir.

* * * * *

UNITED STATES PATENT AND TRADEMARK OFFICE

CERTIFICATE OF CORRECTION

PATENT NO. : 7,296,881 B2
APPLICATION NO. : 11/040601
DATED : November 20, 2007
INVENTOR(S) : Jeffrey D. Langford et al.

It is certified that error appears in the above-identified patent and that said Letters Patent is hereby corrected as shown below:

In column 7, lines 14-15, in Claim 16, delete “the de-primed” and insert -- a de-primed --, therefor.

In column 8, lines 15-16, in Claim 20, delete “the de-primed” and insert -- a de-primed --, therefor.

Signed and Sealed this

Fifth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,296,881 B2
APPLICATION NO. : 11/040601
DATED : November 20, 2007
INVENTOR(S) : Jeffrey D. Langford et al.

It is certified that error appears in the above-identified patent and that said Letters Patent is hereby corrected as shown below:

In column 7, lines 14-15, in Claim 16, delete “the de-primed” and insert -- a de-primed --, therefor.

In column 8, lines 15-16, in Claim 20, delete “the de-primed” and insert -- a de-primed --, therefor.

Signed and Sealed this

Second Day of September, 2008

JON W. DUDAS
*Director of the United States Patent and Trademark Office*